US011959734B2

(12) United States Patent
Wilkes

(10) Patent No.: US 11,959,734 B2
(45) Date of Patent: Apr. 16, 2024

(54) TRAINING CARTRIDGE

(71) Applicant: Seismic Ammunition, Inc., Oklahoma City, OK (US)

(72) Inventor: Matthew Wilkes, Oklahoma City, OK (US)

(73) Assignee: SEISMIC AMMUNITION, INC., Oklahoma City, OK (US)

( * ) Notice: Subject to any disclaimer, the term of this patent is extended or adjusted under 35 U.S.C. 154(b) by 0 days.

(21) Appl. No.: 18/097,767

(22) Filed: Jan. 17, 2023

(65) Prior Publication Data

US 2023/0228545 A1 Jul. 20, 2023

Related U.S. Application Data

(60) Provisional application No. 63/300,210, filed on Jan. 17, 2022.

(51) Int. Cl.
*F42B 14/02* (2006.01)
*F42B 8/12* (2006.01)

(52) U.S. Cl.
CPC ..... *F42B 8/12* (2013.01); *F42B 14/02* (2013.01)

(58) Field of Classification Search
CPC ..... F42B 8/12; F42B 14/02
See application file for complete search history.

(56) References Cited

U.S. PATENT DOCUMENTS 14,315 A * 2/1856 James ..... F42B 14/02 102/525
29,272 A * 7/1860 Hotchkiss ..... F42B 14/02 102/525
33,718 A * 11/1861 Tice ..... F42B 14/02 102/525
34,493 A * 2/1862 Havens ..... F42B 14/02 102/525
40,153 A * 10/1863 Billings ..... F42B 14/02 102/525
47,754 A * 5/1865 Smith ..... F42B 14/02 102/526
148,330 A * 3/1874 Sibley ..... F42B 5/24 102/525
157,378 A * 12/1874 Conner ..... F42B 14/02 102/526
RE8,308 E * 6/1878 Reilly ..... 102/526
214,843 A * 4/1879 Reilly ..... F42B 14/02 86/52
225,650 A * 3/1880 Sibley ..... F42B 14/02 102/525

(Continued)

OTHER PUBLICATIONS

Product Catalog, Defense Technology, Direct Impact 40 MM Reloadable Munitions, retrieved from https://www.defense-technology.com/product-category/40mm-munitions-impact-munitions/, pp. 1-10, Nov. 29, 2022.

*Primary Examiner* — Derrick R Morgan
(74) *Attorney, Agent, or Firm* — McAfee & Taft

(57) ABSTRACT

A cartridge to be fired through a barrel comprises a cartridge body with a maximum outer diameter, and a removable and replaceable driving band with an outer diameter greater than the diameter of the cartridge body. The driving band is positioned on the cartridge body such that it is the only part of the cartridge that engages the barrel through which it is fired.

14 Claims, 8 Drawing Sheets

(56) References Cited

U.S. PATENT DOCUMENTS 707,135 A * 8/1902 Hudson ..... F42B 14/02 102/527
1,201,935 A * 10/1916 Campbell ..... F42B 14/02 102/525
165,255 A * 4/1919 Reilly ..... F42B 14/02 102/526
1,299,013 A * 4/1919 North ..... F42B 14/02 102/526
1,345,689 A * 7/1920 Morris ..... F42B 14/02 102/527
1,562,495 A * 11/1925 Dalton ..... F42B 14/02 102/519
2,442,369 A * 6/1948 McBride ..... F42B 14/02 102/527
2,715,874 A * 8/1955 Hablutzel ..... F42B 14/02 102/523
2,821,923 A * 2/1958 Alderson ..... F42B 8/20 102/529
3,212,388 A * 10/1965 Rosselet ..... B25C 1/18 102/527
4,016,817 A * 4/1977 Arciniega Blanco ... F42B 10/22 244/3.23
4,108,074 A * 8/1978 Billing, Jr. ..... F42B 8/14 264/328.12
4,140,061 A * 2/1979 Campoli ..... F42B 8/14 102/521
4,307,666 A * 12/1981 Baran ..... F42B 14/02 102/501
4,391,199 A * 7/1983 Morin ..... F42B 8/02 102/374
4,553,482 A * 11/1985 Weber ..... F42B 8/14 102/521
4,558,646 A * 12/1985 Hoffmann ..... F42B 14/02 102/527
4,603,637 A * 8/1986 Snide ..... F42B 8/16 102/517
H198 H * 1/1987 Stone ..... 102/524
4,854,242 A * 8/1989 Katzmann ..... F42B 12/06 102/517
4,905,602 A * 3/1990 Buckland ..... F42B 10/54 102/501
4,938,147 A * 7/1990 Czetto, Jr. ..... F42B 12/34 102/517
5,198,616 A * 3/1993 Anderson ..... F42B 12/74 102/501
5,909,003 A * 6/1999 Burri ..... F42B 14/02 102/518
6,305,293 B1 * 10/2001 Fry ..... F42B 12/78 102/527
6,349,651 B1 * 2/2002 Martinez Garcia ..... F42B 7/10 102/501
7,600,421 B1 * 10/2009 Hollis ..... F42B 35/00 42/1.06
8,171,852 B1 * 5/2012 Rebar ..... F42B 12/34 102/509
8,844,444 B1 * 9/2014 Hooke ..... F42B 35/00 102/524
9,121,679 B1 * 9/2015 Kim ..... F42B 8/12
9,593,921 B1 * 3/2017 Kostka ..... F42B 8/14
11,378,369 B1 * 7/2022 Manley ..... F42B 14/02
2006/0027130 A1 * 2/2006 Parker ..... F42B 14/02 102/524
2013/0199396 A1 * 8/2013 Broden ..... F42B 8/16 102/513
2023/0228544 A1 * 7/2023 Walker ..... F42B 7/08 102/439

* cited by examiner

TRAINING CARTRIDGE

CROSS-REFERENCE TO RELATED APPLICATION

This application claims the benefit of U.S. Provisional Application No. 63/300,210 filed on Jan. 17, 2022, which is hereby incorporated by reference.

It is often necessary in military or law enforcement operations to utilize non-lethal measures to, for example, minimize the risk of casualties where the employment of lethal force is not needed or desired. Such instances may include for example crowd control or peace keeping operations. Training cartridges have been developed to mimic the flight of non-lethal measures, so that users can learn how to properly use non-lethal live rounds, and also to accurately determine the distance and impact generated by non-lethal live rounds. Existing training cartridges have a limited life, in that after use the training cartridge cannot be reused. There are training cartridges that may be used more than once, but ultimately the entire training cartridge must be discarded due to wear or other damage.

BRIEF DESCRIPTION OF THE DRAWINGS

FIG. 13 is a side view of the embodiment of FIG. 12.

DESCRIPTION OF AN EMBODIMENT

Figure 2:
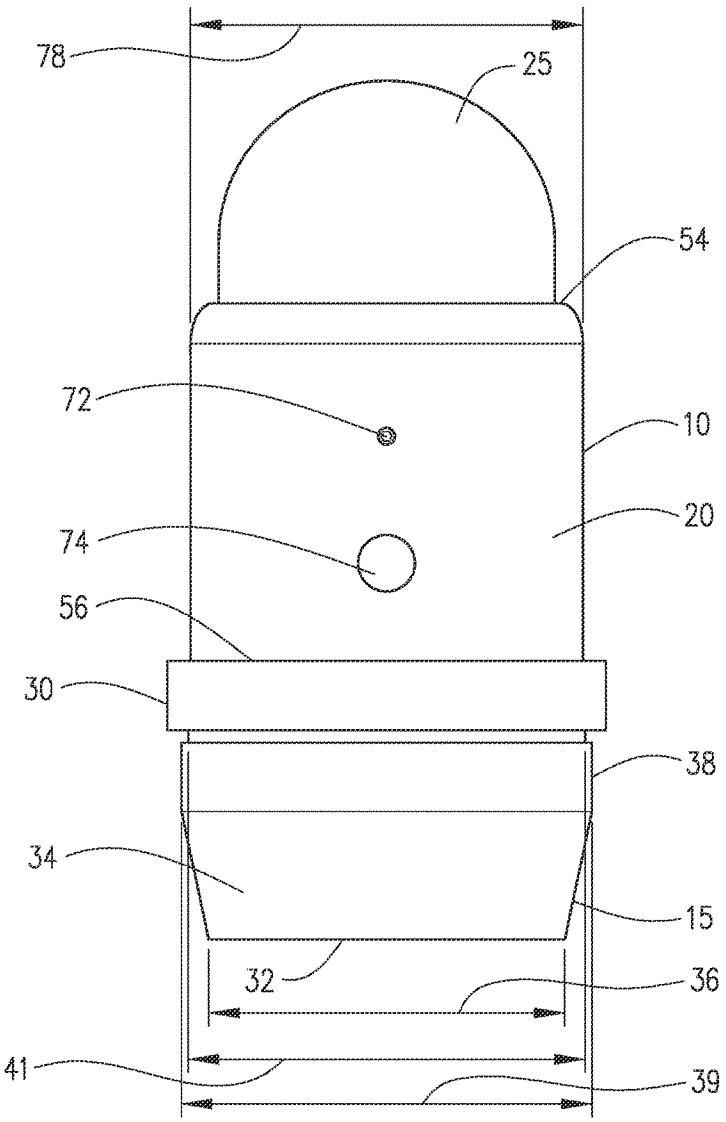
FIG. 2 is a side view of the assembled training cartridge of FIG. 1.
Figure 1:
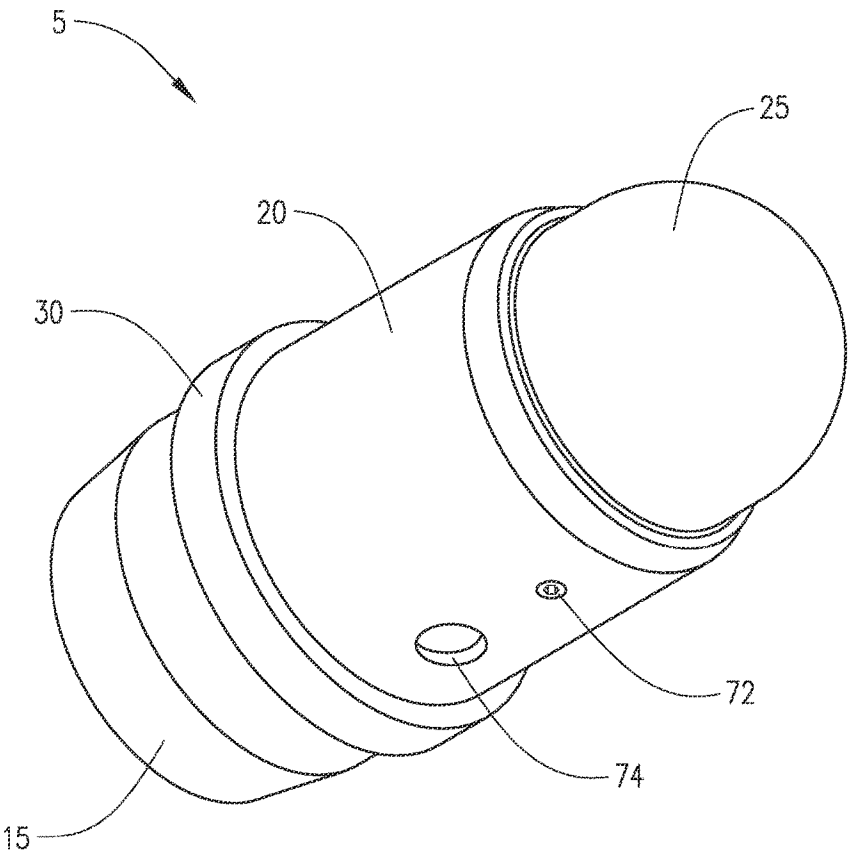
FIG. 1 is a perspective view of an embodiment of an assembled training cartridge of the current disclosure.
Figure 3:
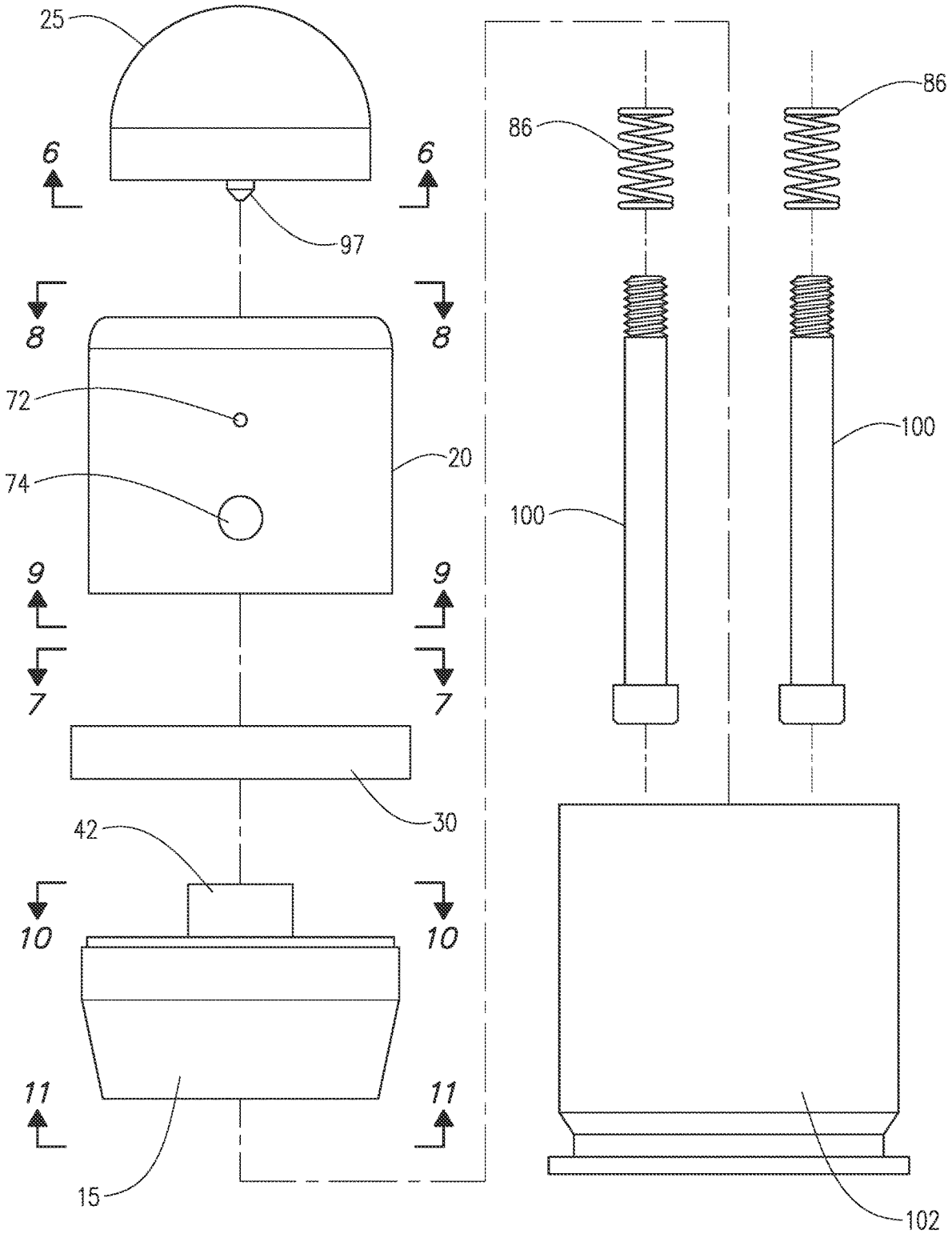
FIG. 3 is an exploded view of the training cartridge of FIG. 1.
Figure 4:
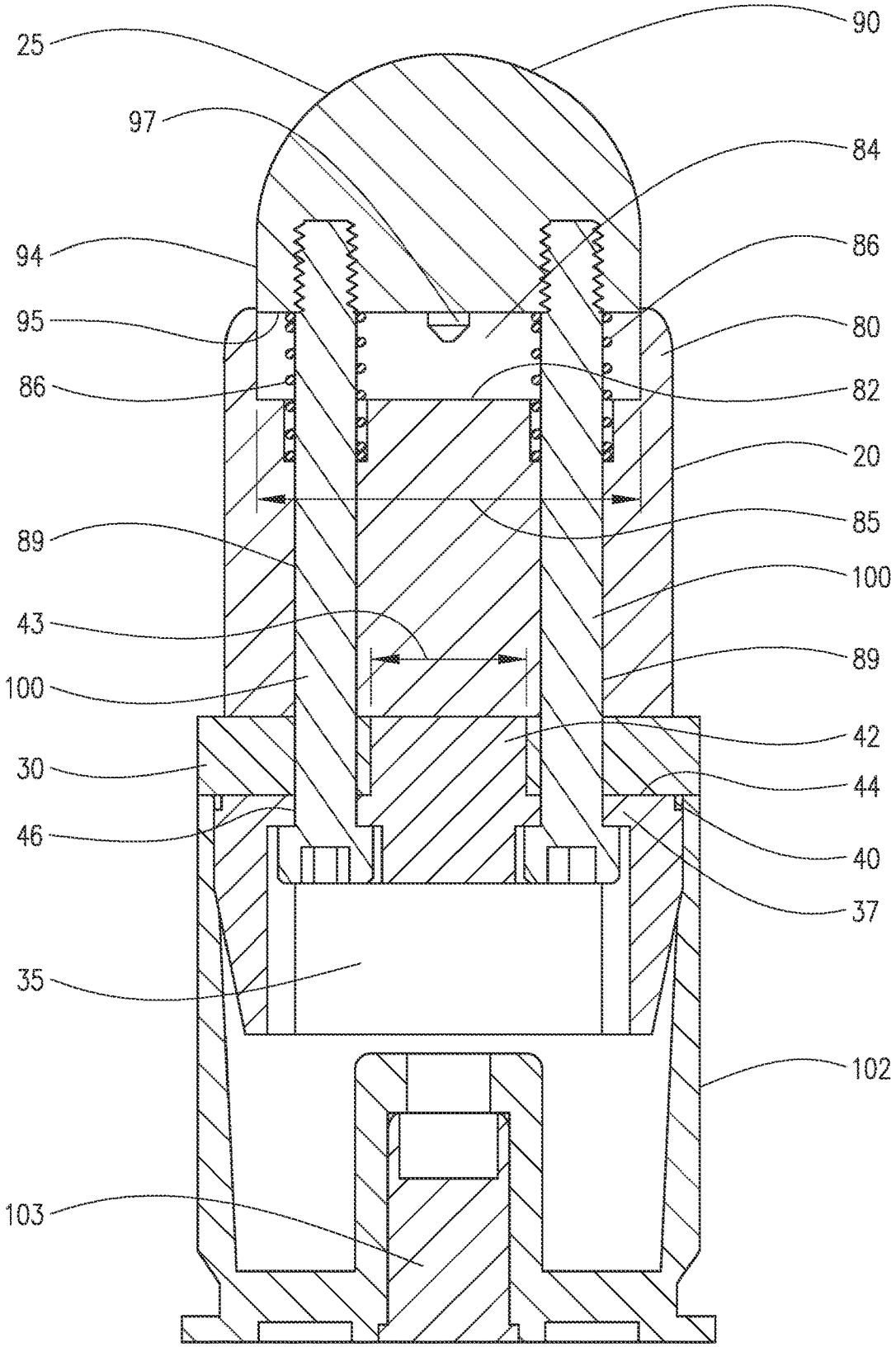
FIG. 4 is a cross section of the training cartridge of FIG. 1.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

The current disclosure is directed to a training cartridge 5. Training cartridge 5 may be for example used as a 40 MM training cartridge but other sizes are also possible. Training cartridge 5 may be utilized for example to mimic the flight and impact of non-lethal measures sometimes utilized by the military and police forces. In addition, the training cartridge 5 can be used recreationally for target practice and other activities.

Training cartridge 5 is a multiple piece training cartridge 5. Training cartridge 5 may comprise a cartridge body 10 which in one embodiment is a multiple piece cartridge body 10 that may comprise a plurality of cartridge body sections. Cartridge body 10 may comprise a rear section 15, a center section 20, and a forward or nose section 25. Training cartridge 5 comprises a band 30 which may be referred to as an engagement, or driving band 30. Driving band 30 is the only portion of training cartridge 5 that will engage the inner surface of the barrel through which it is fired. Driving band 30 is removably positioned between two of the plurality of cartridge body sections. Driving band 30 will be positioned forward of rear section 15 and thus positionally is between the rear section 15 and forward section 25. In the disclosed embodiment driving band 30 is removably positioned directly between the rear section 15 and center section 20 of cartridge body 10. Other embodiments of a training cartridge may comprise a cartridge body that is a single piece cartridge body with an engagement band removably disposed thereabout. In such a case the driving band 30 may comprise an annular ring that circumscribes the cartridge body.

Rear section 15 has a rear end 32 with outer diameter 36. Rear section 15 tapers radially outwardly from diameter 36 in the forward direction and has a tapered portion 34. Rear section 15 defines a cavity 35 that extends from rear end 32 to a connection plate 37 through which connecting fasteners will extend. Rear section 15 has a generally cylindrical portion 38 forward of tapered portion 34 with an outer diameter 39. Outer diameter 39 is the maximum rear section outer diameter. Rear section 15 may have a reduced diameter ridge 40 with an outer diameter 41 at the forward end 44 thereof. A center post 42 extends in the forward direction from forward end 44 of rear section 15. Post 42 has a diameter 43. Rear section 15 has a pair of openings 46 through which fasteners will extend.

Driving band 30 has an opening 48 through which post 42 will extend. Driving band 30 has outer diameter 49 which defines outer peripheral surface 50. Outer surface 50 of band 30 is the only portion of training cartridge 5 that will engage the surface of a barrel through which training cartridge 5 is fired. Driving band 30 has openings 52 through which fasteners will extend in order to assemble training cartridge 5.

Center section 20 is a generally cylindrical center section with forward end 54 and rear end 56. Center section 20 has at least one and in the embodiment described two cavities 58 defined therein extending forward from rear end 56. Cavities 58 are generally cylindrical with a rounded terminus 60 at the forward end thereof. Cavities 58 may retain a marking material therein, which may be for example paint balls. Center section 20 has longitudinal passageways 64 with forward openings 68. Passageways 64 extend from the forward end of cavities 58. A set screw 72 may be utilized to retain shotgun primer in passageways 64, which will detonate and explode paint balls 75 or other marking devices positioned in cavities 58. Center section 20 has ports 74 in the wall thereof that communicate with cavities 58. Paint, or other marking material will be expelled through ports 74 upon the impact of training cartridge 5 with a target, which will cause detonation of the shotgun primer or other detonating material. Center section 20 defines an outer diameter 78 which is a maximum center section outer diameter.

Center section 20 of cartridge body 10 defines a cylindrical rim 80 that extends upwardly from a surface 82. Forward openings 68 are defined on surface 82. Rim 80 defines a receptacle 84 for receiving nose piece 25. Rim 80 has an inner diameter 85. A pair of compression springs 86 will rest upon surface 82. Center section 20 has openings 89 that extend from the rear end thereof to surface 82. Fasteners 100 will extend through openings 89 for the assembly of training cartridge 5. Compression springs 86 may be disposed about fasteners 100, and engage the lower end of nose section 25 and extend into an openings 91 in the upper end of center section 20.

Nose piece 25 is a rounded nose piece with a rounded nose at a forward end 90 thereof. Nose piece 25 transitions from rounded nose at forward end 90 to a generally cylindrical portion 94 that extends to a rear end 95. Rear end 95 has outer diameter 96 which is a maximum nose section outer diameter. Rear end 95 of nose piece 25 will be received in receptacle 84. A pair of firing pins 97 extend rearwardly from nose piece 25, and passageways 64 may have shotgun primer positioned therein. Nose piece 25 has threaded openings 98 at the rear end thereof to receive fasteners 100. Fasteners 100 will extend through openings 46 in rear section 15, openings 52 in driving band 30, and openings 89 in center section 20. Fasteners will be threaded into threaded openings 98 in nose piece 25. Compression springs may also be positioned about firing pins 97. Fasteners 100 thus prevent relative rotation between the driving band 30 and rear, center and forward sections 15, 20 and 25. When fired through a rifled barrel, the driving band will rotate, and will cause all of cartridge 5 to rotate as well.

Figure 5:
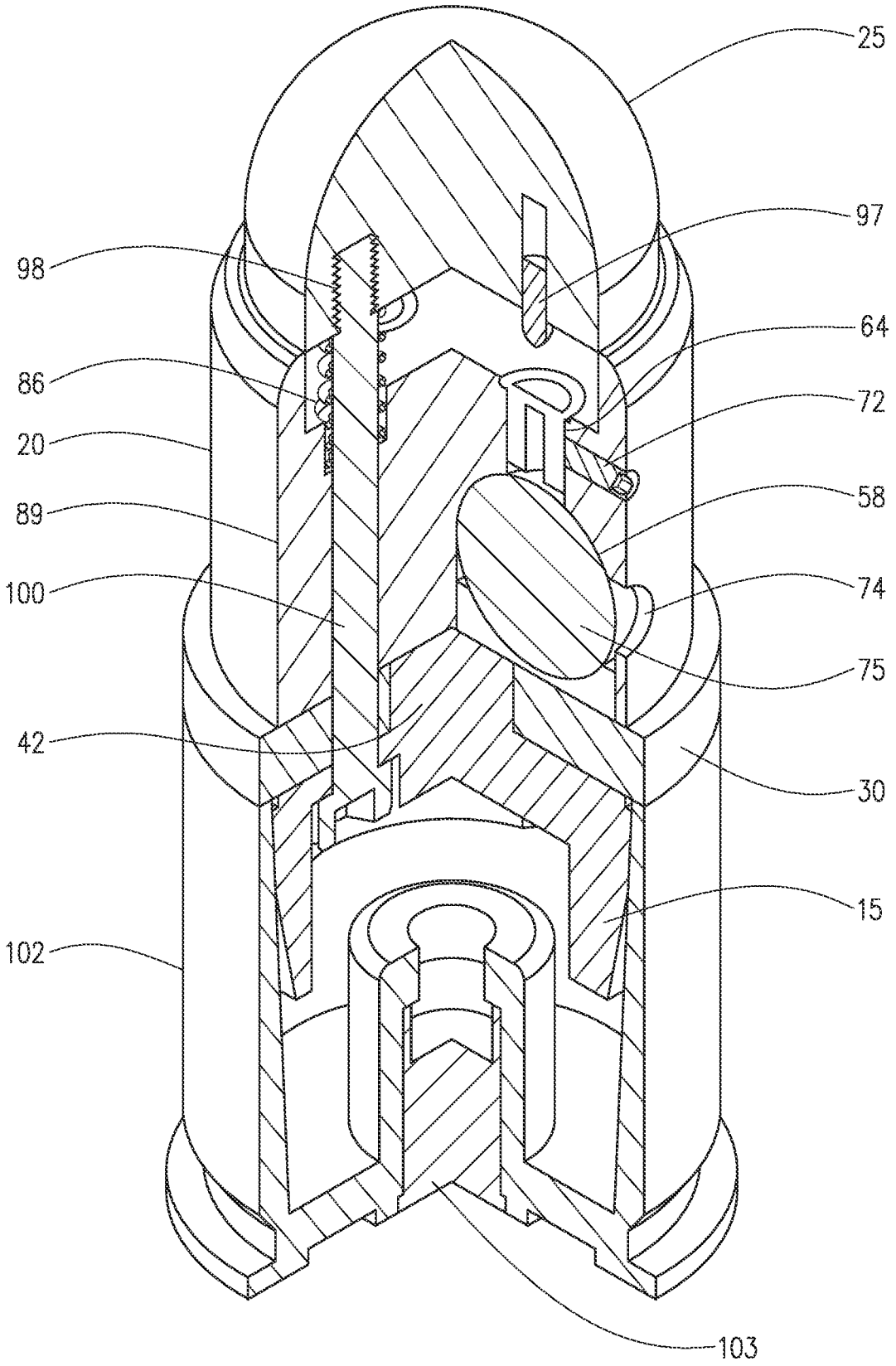
FIG. 5 is a one-quarter section view of the training cartridge of FIG. 1.
Figure 6:
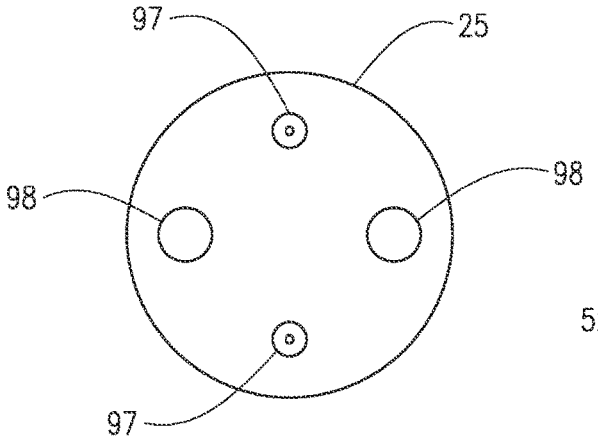
FIG. 6 is a view from line 6-6 of FIG. 3 of the training cartridge.
Figure 7:
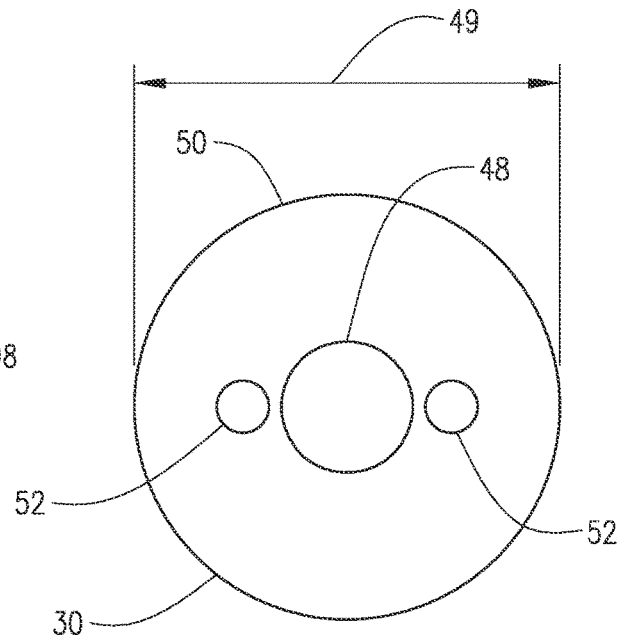
FIG. 7 is a view from line 7-7 of FIG. 3 of the training cartridge of FIG. 1.
Figure 8:
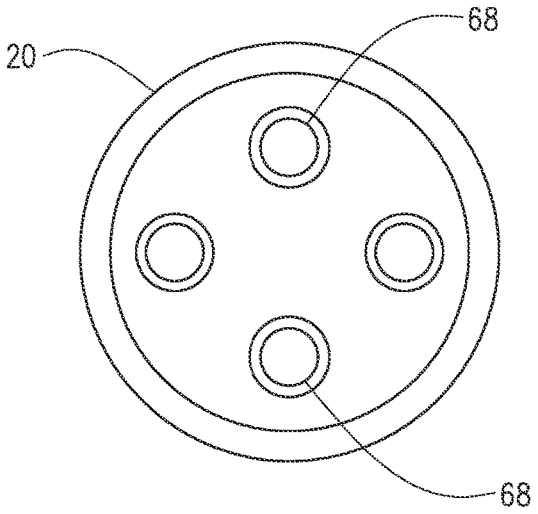
FIG. 8 is a view from line 8-8 of FIG. 3 of the training cartridge of FIG. 1.
Figure 9:
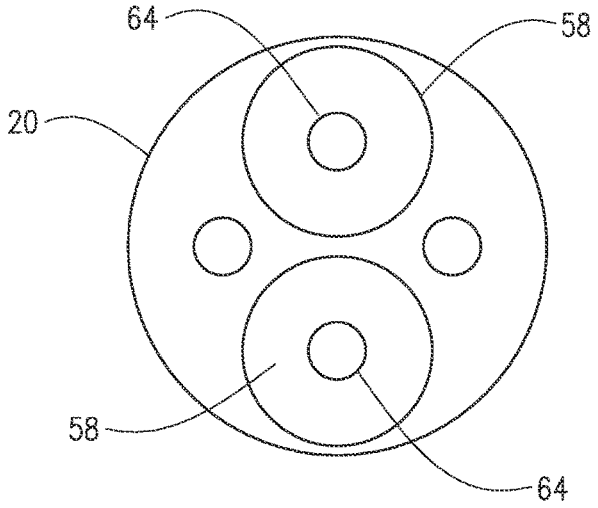
FIG. 9 is a view from line 9-9 of FIG. 3 of the training cartridge of FIG. 1
Figure 10:
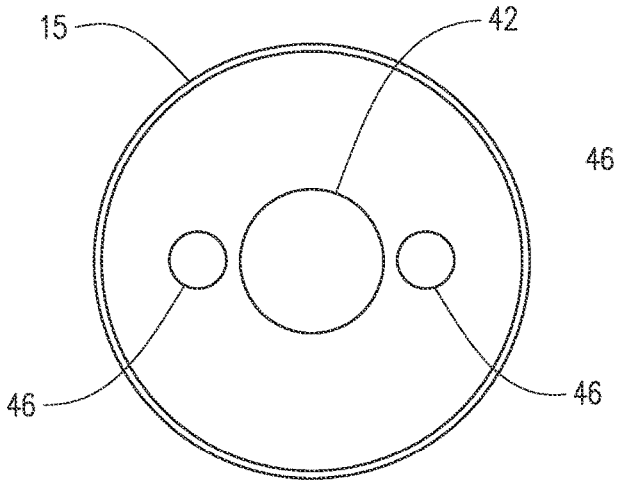
FIG. 10 is a view from line 10-10 of FIG. 3 of the training cartridge of FIG. 1.
Figure 11:
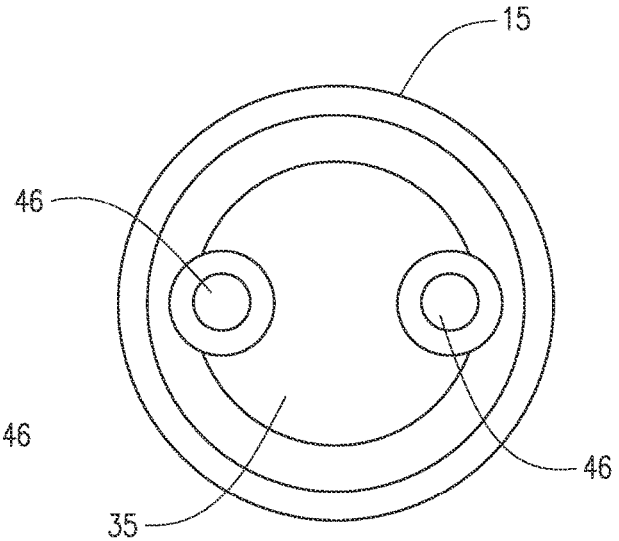
FIG. 11 is a view from line 11-11 of FIG. 3 of the training cartridge.
Figure 12:
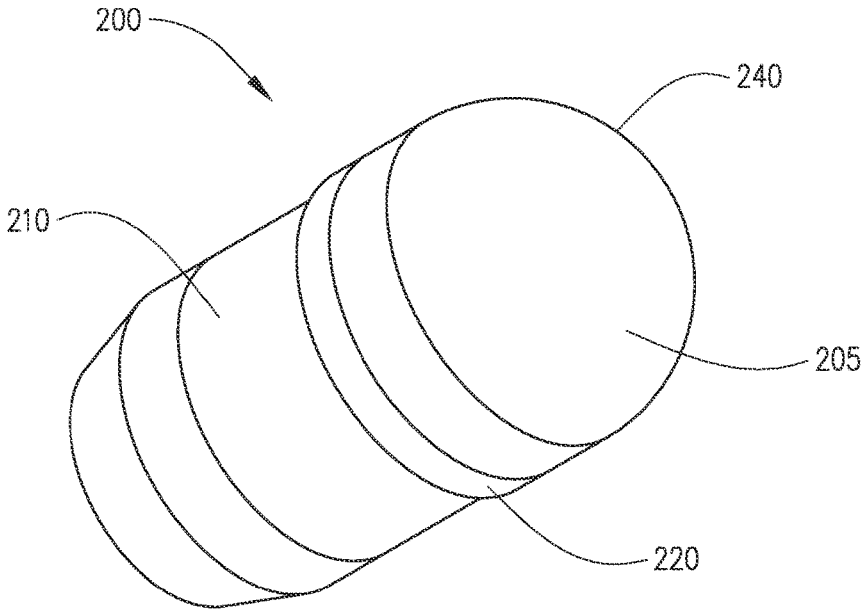
FIG. 12 is a perspective view of an additional embodiment of a training cartridge.
Figure 14:
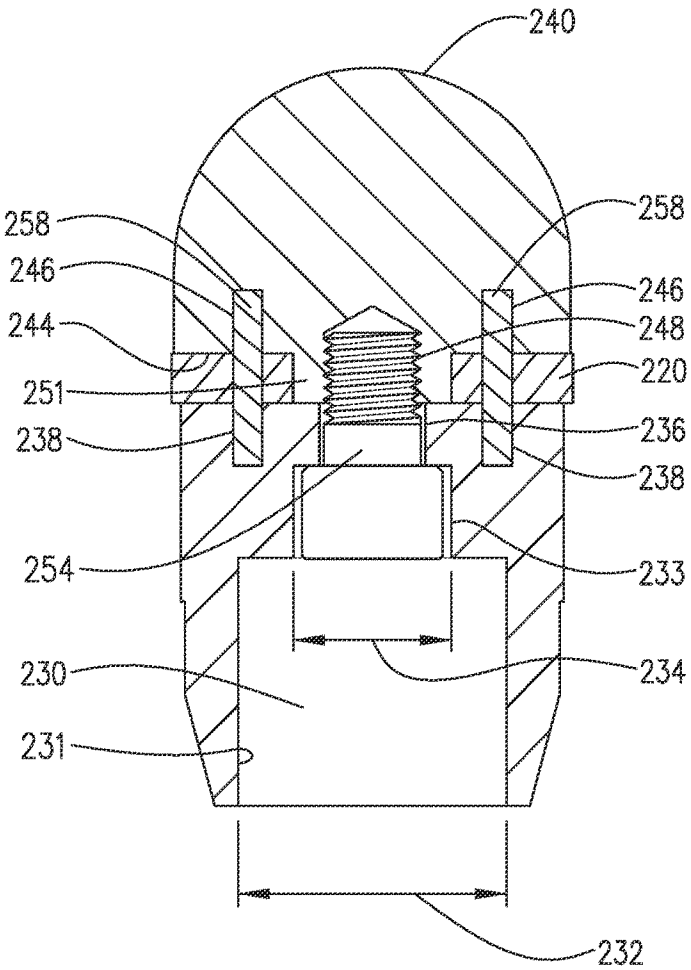
FIG. 14 is a cross-section view of the embodiment of FIG. 12.
Figure 15:
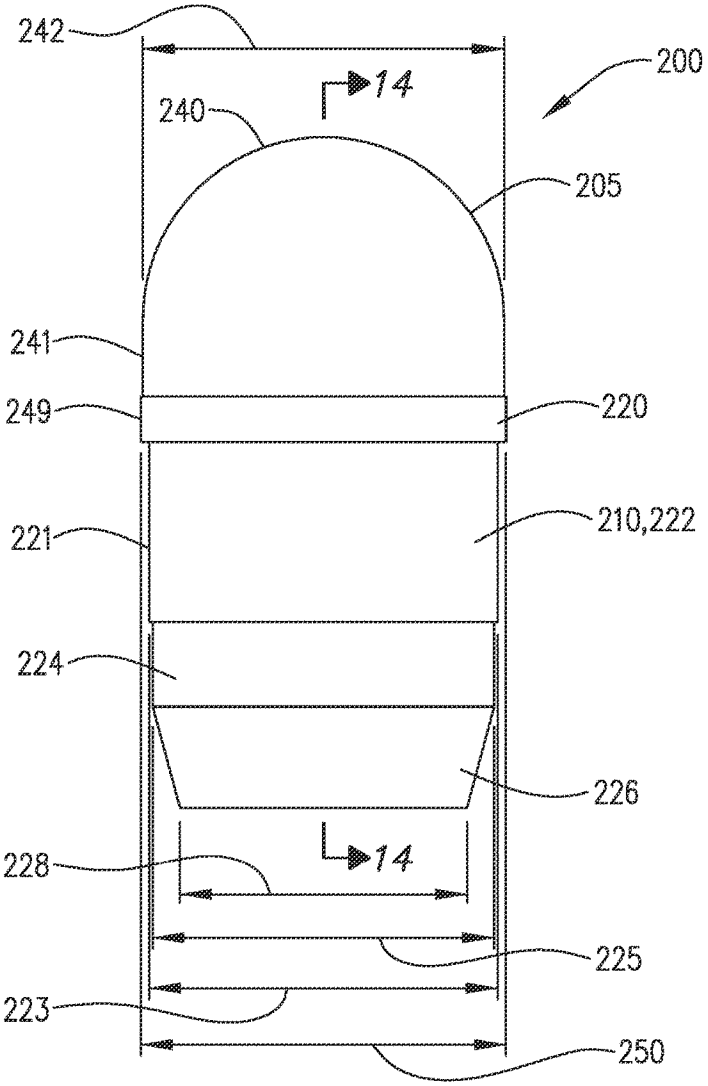
FIG. 15 is a side view of the driving band of FIG. 12.
Figure 15:
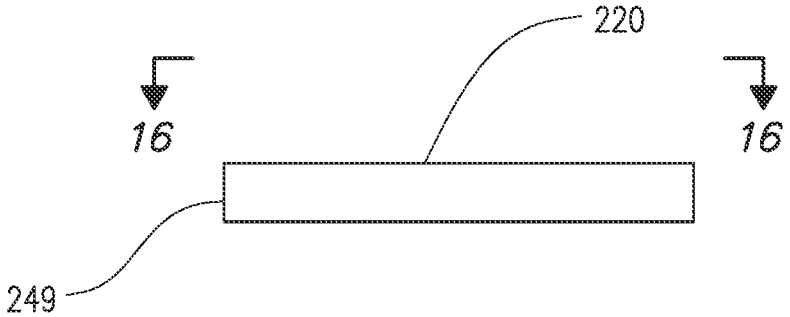
Figure 16:
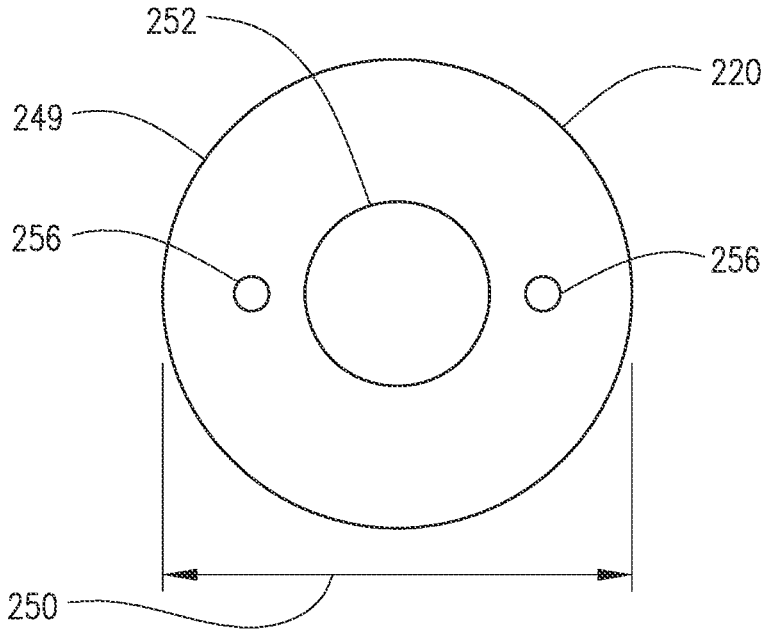
FIG. 16 is a view from line 16-16 of FIG. 15.

It is understood that training cartridge 5 will be positioned in a casing 102 which will have a firing mechanism 103 therein. In the described embodiment, a .38 caliber blank is utilized as the firing mechanism. FIG. 5 shows training cartridge 5 with rear section 15 inserted in casing 102. The .38 caliber blank or other firing mechanism 103 will be placed in casing 102 below rear section 15.

In use, training cartridge 5 with casing 102 is positioned in a launcher of a type known in the art. Detonation of the firing mechanism 103 will impel training cartridge 5 through a barrel of the launcher. The only portion of the training cartridge 5 that will engage the barrel surface is the outer surface of driving band 30. Nose piece 25 of training cartridge 5 will, upon impact with a target, compress springs 86 so that firing pins 97 will engage the shotgun primer in passageways 64 which will explode. Fasteners 100 allow for the compression of the springs 86, which will provide separation between the firing pin and shotgun primer until impact with the ground or other target. Upon impact the explosion created by firing pins 97 and shotgun primer or other detonation mechanism will cause the paint balls to explode and paint will pass through ports 74 onto the target area hit by the training cartridge 5. The paint will indicate the impact location and identify the point of impact. In addition, the shotgun primer will detonate causing an explosion which will indicate that impact has occurred.

Materials that may be used for the training cartridge 5 include, for example, aluminum for the nose piece 25, center section 20 and rear section 15. The engagement band 30 may be made from a plastic or a metal that will be softer than the barrel through which it is fired, so that the band 30 will wear as opposed to the barrel. The training cartridge 5 will be made such that the flight pattern and distance of training cartridge 5 will mimic that of an actual operational cartridge that may be used for non-lethal application by authorities such as military and police forces.

Because only the driving band 30 engages the surface of the barrel through which the training cartridge 5 is fired, training cartridge 5 may be used an indefinite number of times without replacement. The only part of training cartridge 5 that will require replacement is driving band 30. Training cartridge 5 can be disassembled by simply removing screws 100, and a new band 30 used to replace the worn band 30, and then reassembled simply by threading fasteners 100 into openings 98. Many prior art training cartridges must be replaced in their entirety after being fired a single time. Others may be fired perhaps 3-5 times prior to being replaced, but in any event require replacement of the entire cartridge.

The training cartridge 5 is thus a reusable training cartridge that can be effectively used an indefinite number of times without replacement of any portion thereof other than the engagement band. When the engagement band becomes worn, it can simply be removed and replaced. In an additional embodiment, the training cartridge may be, for example, a solid body with a replaceable engagement band disposed thereabout. The solid body may be shaped similarly to the assembled rear, center and nose sections as described herein, and the replaceable engagement band disposed about the solid body. The replaceable engagement band would be the only part that would need to be replaced after the training cartridge has been fired and only when the engagement band has been worn such that when fired it does not properly mimic the non-lethal round to which it corresponds. The driving band can then be replaced with a different driving band with a sufficient diameter to adequately engage the barrel through which it is fired. Although described herein as a 40 mm training cartridge, it is understood that other calibers are possible.

An additional embodiment of a training cartridge 200 is shown in FIGS. 12-16. Training cartridge 200 is similar to training cartridge 5 and operates in the same way. Training cartridge 200 has fewer parts, and a simpler assembly than training cartridge 5. Training cartridge 200 comprises a plurality of sections including a forward, or nose section 205 and a rear section 210. A removable and replaceable driving band 220 is positioned between the plurality of sections. Driving band 220 is the only part of the training cartridge 200 that will engage a barrel through which the training cartridge is fired. Rear section 210 has outer surface 221 and has three portions, including a generally cylindrical first portion 222 with an outer diameter 223, a generally cylindrical second portion 224 with outer diameter 225 and a third portion 226 that tapers radially inwardly from diameter 225 to an outer diameter 228 at the rearward end of rear section 210. Outer diameter 223 defined on outer surface 221 is the maximum outer diameter of rear section 210.

Rear section 210 has a cavity 230 defined therein with first and second generally cylindrical portions 231 and 233 defining inner diameters 232 and 234. An opening 236 extends forward from second portion 233 and will receive the shank of a fastener as described below. Rear section 210 has a plurality, and in the embodiment described two pin holes 238 defined in the forwardmost end thereof and extending rearwardly therefrom.

Forward section 205 has a rounded nose 240 at the forwardmost end thereof and has a generally cylindrical section 241 defining an outer diameter 242, which is the outermost diameter of forward section 205. A plurality of pin holes 246, and in the embodiment described two pin holes 246 are defined in the rear face 244 of forward section 205. Rear face 244 also has a threaded opening 248 therein. Rear face 244 may have post 251 extending rearwardly into which a fastener may be threaded.

Removable and replaceable driving band 220 has outer surface 249 that defines an outer diameter 250. Driving band 220 has central opening 252 therethrough. A fastener 254 is inserted through opening 252 in driving band 220 and opening 236 in rear section 210. Fastener 254 is threaded into threaded opening 248 to connect the rear section 210 to forward section 205 with driving band 220 therebetween. Driving band 220 has pin holes 256 therein. Pins 258 pass through pin holes 256, and extend from pin holes 238 in rear section 210 into pin holes 246 in forward section 205. Pins 258 prevent relative rotation between the driving band 220 and forward and rear sections 205 and 210, As a result, if the training cartridge is fired through a rifled barrel, the driving band will rotate, and the rear and forward sections 210 and 205 will rotate therewith.

A method of using a training cartridge may include the steps of assembling a training cartridge with a removable driving band and placing the training cartridge in a barrel of a launcher. The training cartridge may comprise a training cartridge body having a maximum body outer diameter and a driving band removably affixed thereto, the driving band having a driving band outer diameter that is greater than the maximum body outer diameter. The method may further include firing the training cartridge through the barrel of the launcher a plurality of times. The method may also include removing the driving band after it has become worn such that it does not adequately engage the barrel and mimic the flight of an operational cartridge. The method may further include placing a different driving band on the training cartridge that has a sufficient outer diameter to adequately engage the barrel of the launcher and mimic the flight pattern of an operational cartridge. Removing and replacing the driving band step may comprise disconnecting a plurality of sections of a training cartridge body from one another, removing the driving band from between the cartridge body sections, positioning a replacement driving band between two of the plurality of sections and reconnecting the plurality of sections.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A cartridge to be fired through a barrel comprising:
a forward section defining a forward section maximum outer diameter;
a rear section defining a rear section maximum outer diameter;
a replaceable driving band removably positioned on the cartridge between the forward and rear sections, the driving band defining a driving band outer diameter that is engageably receivable in the barrel, such that the driving band engages the barrel through which the cartridge is fired; and
a plurality of pins extending axially along a length of the cartridge from the rear section through the driving band into the forward section to prevent relative rotation between the driving band and the forward and rear sections.

2. The cartridge of claim 1, the driving band outer diameter being larger than the forward section and rear section maximum outer diameters and is the only part of the cartridge that engages the barrel through which the cartridge is fired.

3. The cartridge of claim 1, the plurality of pins comprising at least one removable fastener extending from the rear section through the driving band into the forward section, and disconnectedly connecting the rear section to the forward section.

4. The cartridge of claim 1 further comprising a center section between the rear and forward sections, wherein the driving band is positioned directly between the rear and center sections and wherein the driving band has a larger outer diameter than a maximum outer diameter of the center section.

5. The cartridge of claim 1, wherein the driving band is made from a polymeric material.

6. The cartridge of claim 4, wherein the rear and forward sections are comprised of a metallic material.

7. A method of using a training cartridge comprising:
placing the training cartridge in a barrel, the training cartridge comprising a plurality of cartridge body sections and a driving band positioned between two of the plurality of cartridge body sections, the cartridge body having a maximum body outer diameter, the driving band having a driving band outer diameter;
firing the training cartridge through the barrel;
locating the training cartridge after the cartridge has been fired;
repeating the firing and locating steps a plurality of times; and
removing and replacing the driving band after the training cartridge has been fired a plurality of times, the plurality of cartridge body sections and the driving band being pinned together with a plurality of pins extending axially along a length of the cartridge to prevent relative rotation therebetween.

8. The method of claim 7, the driving band outer diameter being greater than the maximum
cartridge body outer diameter.

9. The method of claim 8, the removing and replacing step comprising disconnecting the plurality of sections from one another, removing the driving band from between the cartridge body sections, positioning a replacement driving band between two of the plurality of sections and reconnecting the plurality of sections.

10. The method of claim 7, further comprising:
inspecting the driving band after it has been fired a plurality of times; and the removing and replacing step being performed after a driving band outer surface has been worn such that the outer diameter of the driving band is no longer a size that will engage the barrel through which it is fired and mimic the flight of a non-lethal measure.

11. A reusable training cartridge comprising:

a cartridge body defining a maximum body outer diameter; and a removable and replaceable driving band defining a driving band outer diameter that is greater than the maximum body outer diameter, the driving band being removably connected to the cartridge body and being the only portion of the training cartridge that will engage a barrel through which the training cartridge is fired, the cartridge body comprising a plurality of cartridge body sections, the removable and replaceable driving band being positioned between two of the plurality of body sections; and a plurality of pins extending axially along a length of the cartridge through the plurality of body sections and through the removable driving band to prevent relative rotation therebetween.

12. The reusable training cartridge of claim 11, the cartridge body sections comprising:

a nose section;

a center section; and a rear section, the driving band positioned between the center and rear sections.

13. The reusable training cartridge of claim 11, the cartridge body comprising at least a rear section and a forward section with the removable driving band positioned between the rear and forward sections.

14. The reusable training cartridge of claim 11, the cartridge body and driving band being comprised of dissimilar materials.

* * * * *